US011375856B1

(12) United States Patent
Kircher

(10) Patent No.: US 11,375,856 B1
(45) Date of Patent: Jul. 5, 2022

(54) COVERTABLE BATHUB AND SHOWER ASSEMBLY

(71) Applicant: Matthew T. Kircher, Clayton, NC (US)

(72) Inventor: Matthew T. Kircher, Clayton, NC (US)

( * ) Notice: Subject to any disclaimer, the term of this patent is extended or adjusted under 35 U.S.C. 154(b) by 0 days.

(21) Appl. No.: 17/499,019

(22) Filed: Oct. 12, 2021

(51) Int. Cl.
*A47K 3/14* (2006.01)
*A47K 3/28* (2006.01)
*A47K 3/02* (2006.01)

(52) U.S. Cl.
CPC ..... *A47K 3/14* (2013.01); *A47K 3/02* (2013.01); *A47K 3/283* (2013.01)

(58) Field of Classification Search
CPC ..... A47K 3/14; A47K 3/02; A47K 3/283
USPC ..... 4/555–557
See application file for complete search history.

(56) References Cited

U.S. PATENT DOCUMENTS 3,257,669 A 6/1966 Fay
3,559,634 A 2/1971 Lillywhite
4,118,810 A * 10/1978 Brickhouse ..... A47K 3/006 4/556
5,184,358 A * 2/1993 Gruidel ..... A47K 3/006 277/647
6,101,642 A 8/2000 Auten et al.
6,237,537 B1 5/2001 Winchester
8,230,568 B2 * 7/2012 Stafford ..... A47K 3/006 4/559
9,416,538 B2 8/2016 Torres et al.
10,463,200 B2 * 11/2019 Patterson ..... A47K 3/281
2005/0102746 A1 * 5/2005 Wright ..... A47K 3/006 4/555
2010/0236041 A1 9/2010 Stafford
2011/0035871 A1 2/2011 Seymour et al.
2013/0283518 A1 * 10/2013 Ciechanowski ..... E03C 1/2306 4/555

* cited by examiner

*Primary Examiner* — Tuan N Nguyen
(74) *Attorney, Agent, or Firm* — Ashley D. Johnson; Dogwood Patent and Trademark Law

(57) ABSTRACT

The invention is generally directed to a bathing assembly that allows for conversion between a bathtub and shower as desired by the user. The assembly includes a bathtub insert positioned on one of the bathtub sidewalls. The insert is watertight and allows the bathtub to function fully when installed. The insert can be easily removed from the bathtub sidewall, allowing access to the shower stall with minimal step over barrier. A hanger is positioned on one wall of the shower stall to retain the insert until it is needed again (e.g., when a user desires to take a bath). The assembly further includes an overflow drain positioned in the bathtub sidewall opening created when the insert is removed, acting as an added safety feature when the shower is in use. The assembly therefore allows a user to enjoy the benefits of both a walk-in shower and bathtub without requiring major renovations or costly updates.

20 Claims, 13 Drawing Sheets

COVERTABLE BATHUB AND SHOWER ASSEMBLY

TECHNICAL FIELD

The presently disclosed subject matter is generally directed to a bathing assembly that can be quickly and easily converted from a shower to a bathtub and vice versa.

BACKGROUND

Shower stalls typically include at least one wall and a planar floor comprising a shower drain. The shower wall and floor create a shower cavity and an opening to enter and exit the shower. A pivotable door or shower curtain is provided across the shower opening to allow easy entry into the shower cavity and to create a privacy barrier. A water-dispensing head and a spigot provide water within the shower cavity. Because shower stalls are not designed to retain a specified volume of water, the floor portion of the shower is generally not suitable to allow a user to take a bath.

Many people prefer to have a versatile space to accommodate a bath as well as shower. As such, shower stalls are often combined with bathing tubs to form a combination stall-tub fixture. The bathing tub is positioned on a bathroom floor and the shower stall is erected around the bathing tub. Water is then either drawn into the bathing recess for a submersion bath or routed to an upper water-dispensing head and dispensed into the shower cavity. However, because bathing tubs typically have at least one side wall extending in a direction substantially perpendicular to the bathroom floor across the shower opening, users must step over the steep sidewall of the bathtub to enter and exit the shower. This can be extremely problematic for elderly people, children, and those with disabilities.

R is often an expensive and time-consuming undertaking to convert a shower stall and bathing tub into a single bathtub or shower only. Therefore, it would be beneficial to provide a bathing assembly that can be quickly and easily converted from a shower to a bathtub and vice versa.

SUMMARY

In some embodiments, the presently disclosed subject matter is directed to a bathing assembly comprising a shower base defined by one or more walls. The assembly also includes a bathtub unit defined by interconnected sidewalls and a base that create an upper bathtub edge and an interior with a central opening. The assembly comprises a removable sidewall insert that includes a portion of the top edge of one of the bathtub sidewalls, wherein the insert can be removed from the sidewall to create a sidewall opening defined by two sides and a bottom edge. In some embodiments, the bottom edge of the sidewall opening comprises a drain. Further, the removable insert comprises a retention element (e.g., latch) that cooperates with the drain to retain the insert within the opening, and the retention element can be actuated to release the insert from the bathtub opening upon demand. The term "retention element" refers to any element that can be used to retain the insert within the bathtub sidewall opening.

In some embodiments, the bathtub unit and the shower base are molded together as one unitary pierce.

In some embodiments, the insert includes a mount that cooperates with a hanger positioned on one wall of the shower.

In some embodiments, the mount is configured as a recess.

In some embodiments, the sidewall opening is configured on an entry side of the bathtub.

In some embodiments, the assembly further includes a seal positioned around the edges of the bathtub opening, around the edges of the removable insert, or both.

In some embodiments, the removable insert is configured in a wedge shape that tapers from a top edge to a bottom edge.

In some embodiments, the removable insert has a length of about 10-90 inches and a width of about 5-20 inches.

In some embodiments, the thickness of the removable insert is equal to the thickness of the corresponding bathtub sidewall.

In some embodiments, the retention element is a cam latch.

In some embodiments, the presently disclosed subject matter is directed to a method of converting a bathtub into a shower. Specifically, the method comprises removing a bathtub insert from a sidewall of the disclosed bathing assembly. Removing the insert exposes the sidewall opening to allow for entry into the shower, thereby converting the bathtub into a shower.

In some embodiments, the shower can be returned to a bathtub by repositioning the insert within the sidewall opening and actuating the retention element to lock the insert into position.

DETAILED DESCRIPTION

Figure 1:
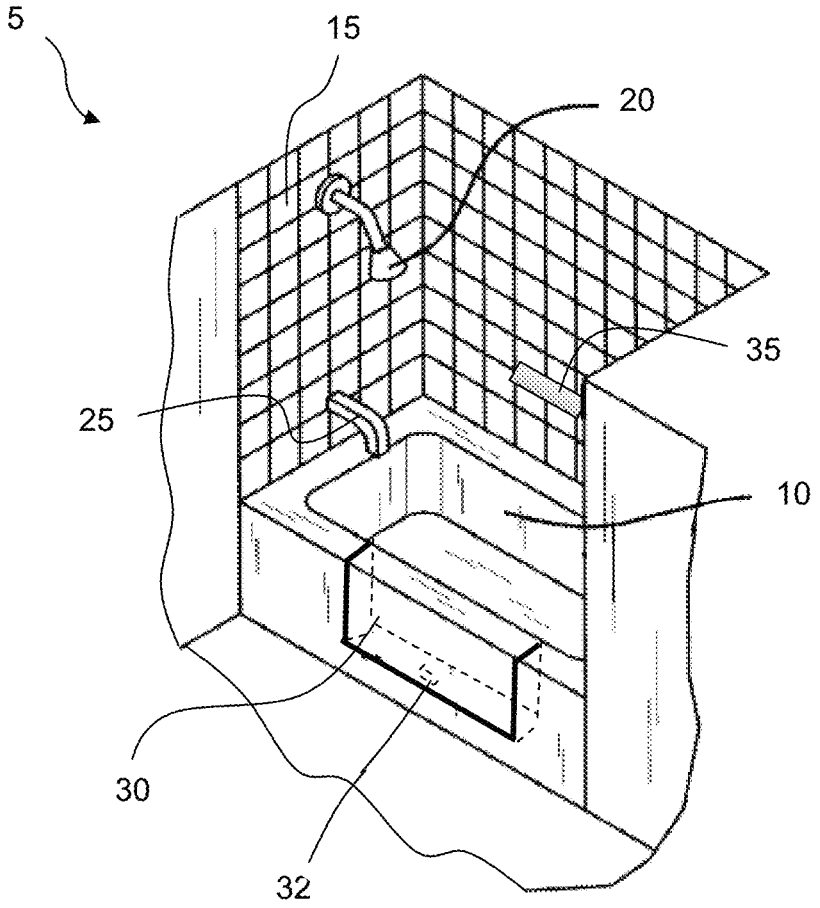
FIG. 1 is a perspective view of a bathing assembly in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a bathing assembly that allows for conversion between a bathtub and shower as desired by the user. FIG. 1 illustrates one embodiment of bathing assembly 5 comprising bathtub 10 and shower stall 15. The assembly includes shower head 20 and tub head 25 to provide water when using the shower and bathtub, respectively. Advantageously, the bathtub includes insert 30 positioned on one of the bathtub sidewalls. Insert 30 is watertight and allows the bathtub to function fully when installed. The insert can be easily removed from the bathtub sidewall, allowing access to the shower stall with minimal step over barrier. Hanger 35 is positioned on one wall of the shower stall to retain the insert until it is needed again (e.g., when a user desires to take a bath). The assembly further includes overflow drain 32 positioned in the bathtub sidewall opening created when the insert is removed, acting as an added safety feature when the shower is in use. Assembly 5 therefore allows a user to enjoy the benefits of both a shower and bathtub without requiring major renovations or costly updates.

Figure 2A:
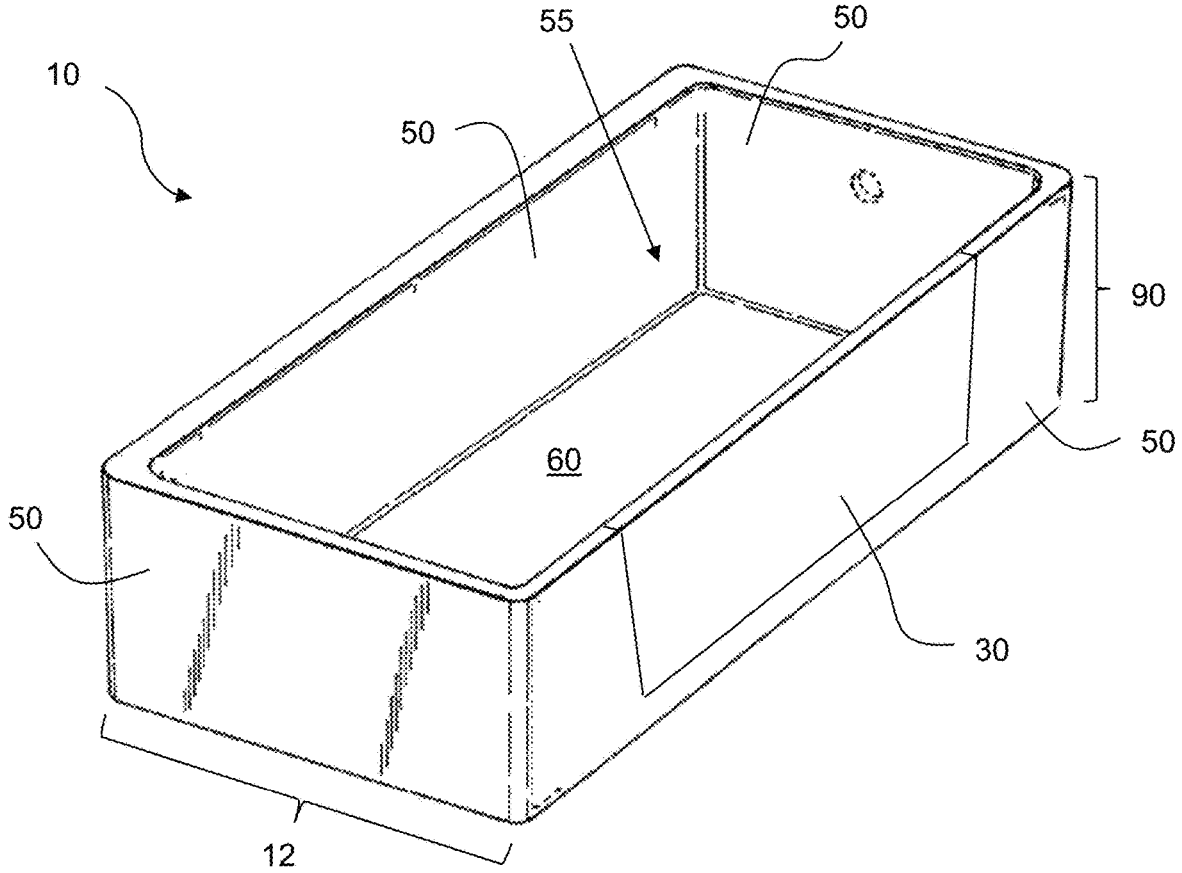
FIG. 2*a* is a perspective view of a bathing assembly bathtub in accordance with some embodiments of the presently disclosed subject matter.
Figure 2B:
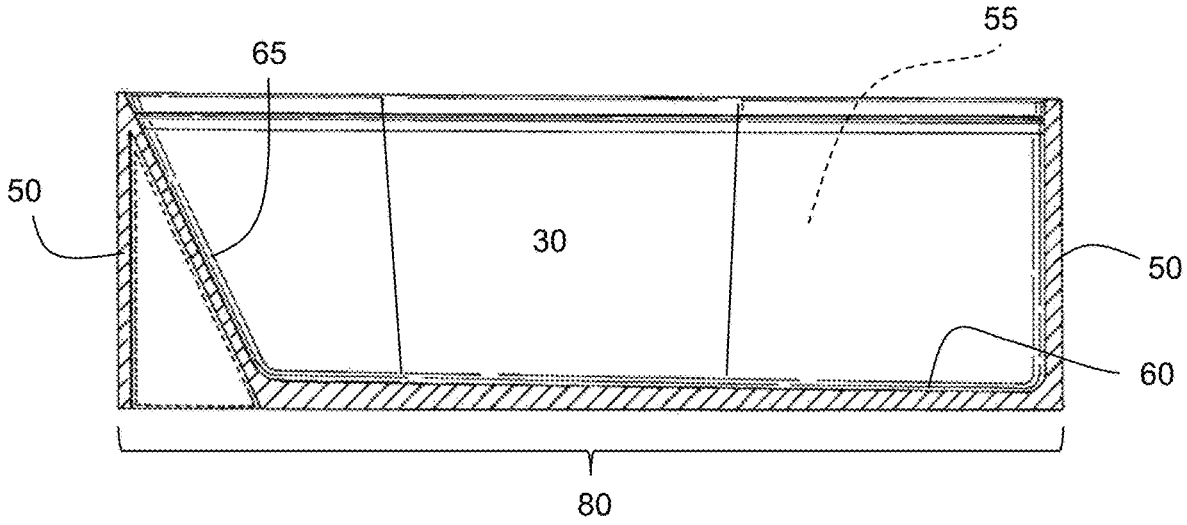
FIG. 2*b* is a side plan view of a bathing assembly bathtub in accordance with some embodiments of the presently disclosed subject matter.
Figure 2C:
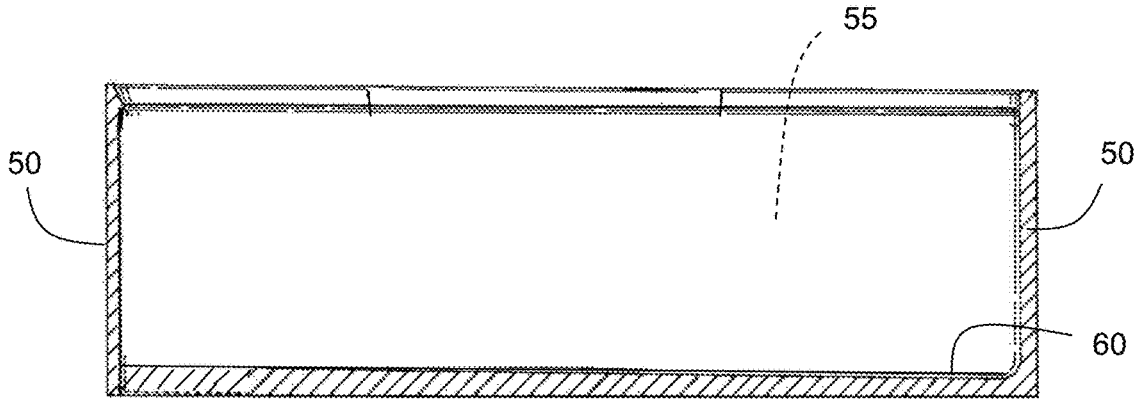
FIG. 2*c* is a side plan view of a bathing assembly bathtub in accordance with some embodiments of the presently disclosed subject matter.

As described above, assembly 5 includes bathtub 10, as illustrated in FIGS. 2*a* and 2*b*. The bathtub includes a plurality of sidewalls 50 that join together to form interior 55 that is sized and shaped to retain water for bathing. The bathtub further includes bottom surface 60 that provides a support for the bather to sit, stand, or lie. The bottom surface of the bathtub typically lies about 3-4 inches above the finished floor line, enabling drain connections to be made after the tub is in place. In some embodiments, the bottom surface of the bathtub can include angled region 65 as an added comfort feature, as shown in FIG. 2*b*. However, the presently disclosed subject matter also includes embodiments wherein the bathtub is partially or substantially horizontal in the use position, as illustrated in FIG. 2*c*.

Figure 2D:
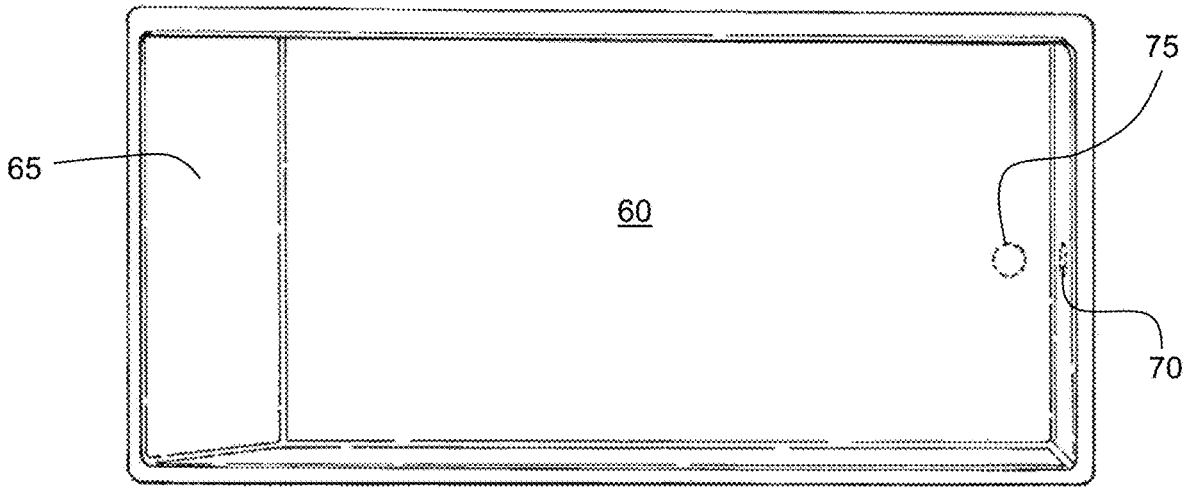
FIG. 2*d* is a top plan view of a bathing assembly bathtub in accordance with some embodiments of the presently disclosed subject matter.

The bathtub also comprises aperture 70 configured to house water dispensing head 25 to distribute water into the bathtub interior. Drain 75 is typically positioned adjacent to or near the bathtub dispensing head and drains water from the interior of the bathtub when the user has finished bathing, as shown in FIG. 2*d*. Any conventional type of bathtub dispensing head and drain can be used.

The bathtub can have length 80 of about 50-100 inches (e.g., at least/no more than about 50, 55, 60, 65, 70, 75, 80, 85, 90, 95, or 100 inches). The term "length" refers to the longest horizontal distance of the bathtub in the use position (e.g., on a support surface such as a bathroom floor). The bathtub can include width 12 of about 20-40 inches (e.g., at least/no more than about 20, 25, 30, 35, or 40 inches). The term "width" refers to the longest straight line distance perpendicular to the length. The tub can also include height 90 of about 10-20 inches (e.g., at least/no more than about 10, 15, or 20 inches). The term "height" refers to the longest vertical distance of the bathtub in the use position. It should be appreciated that the length, width, and height of bathtub 10 is not limited, and the bathtub can be configured in any desired size.

The disclosed bathtub can be configured in any suitable shape, such as the rectangular configuration shown in FIGS. 2*a*-2*d*. However, the bathtub can have any desired shape, such as (but not limited to) square, round, oval, heart-shaped, and the like.

Figure 3A:
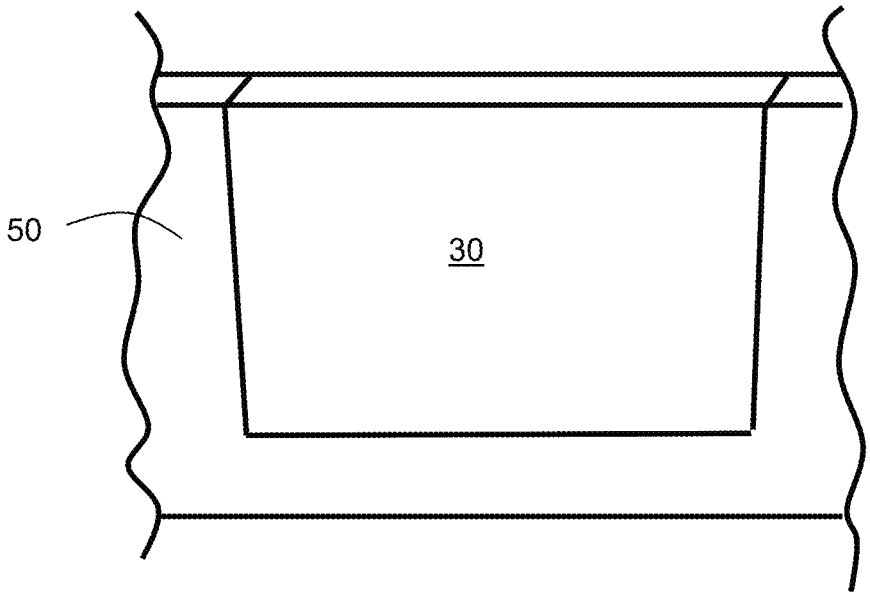
FIG. 3*a* is a fragmentary perspective view of a bathtub insert in accordance with some embodiments of the presently disclosed subject matter.
Figure 3B:
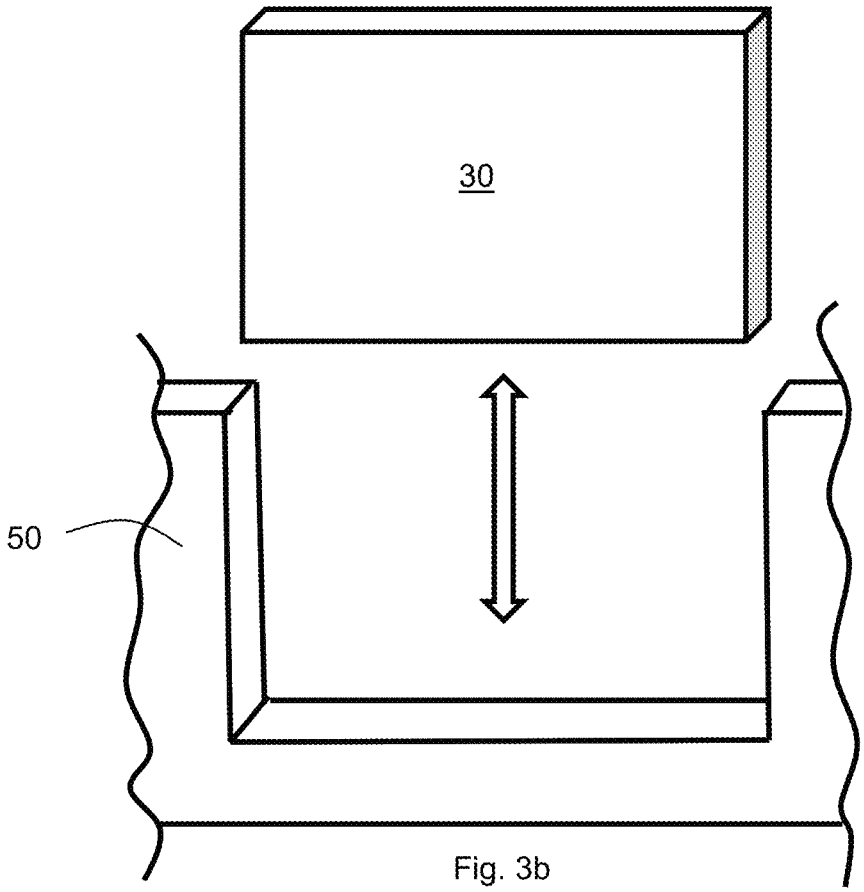
FIG. 3*b* is a fragmentary perspective view of a bathtub insert being added or removed from a bathtub in accordance with some embodiments of the presently disclosed subject matter.
Figure 3C:
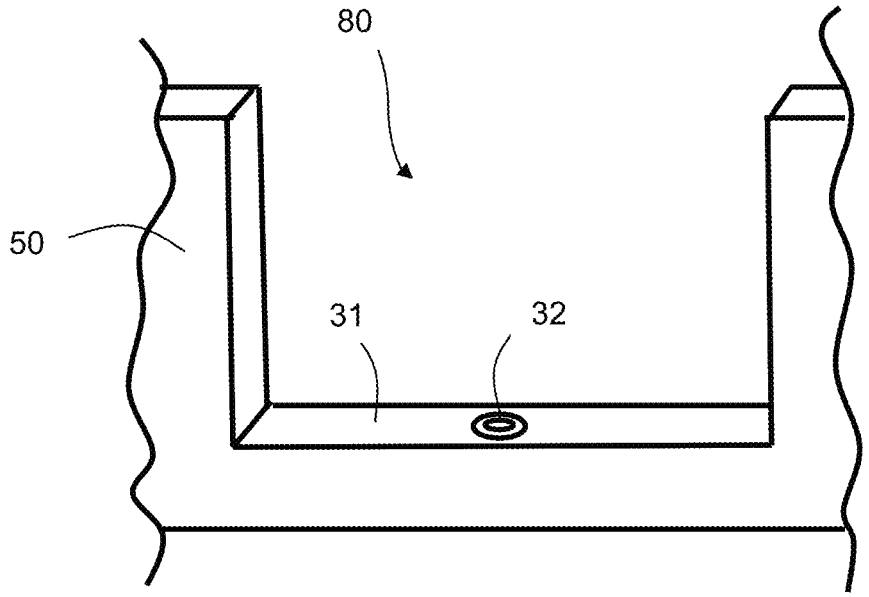
FIG. 3*c* is a fragmentary perspective view of a bathtub insert opening in accordance with some embodiments of the presently disclosed subject matter.

As shown in FIGS. 3*a* and 3*b*, the bathtub includes insert 30 positioned on an entry side of the tub to allow access to the shower with no or minimal step over barrier. After insert 30 has been removed, access opening 80 is formed in the bathtub sidewall, as shown in FIG. 3*c*. The access opening is sized and shaped to retain the insert when desired by the user (e.g., when taking a bath). In addition, opening 80 is large enough to allow a user to easily and safely step through to access the interior of the bathtub, to take a shower. Lower edge 31 of opening 80 includes overflow drain 32. Water can run from drain 32 through standard piping to be disposed of, as would be known in the art.

Alternatively, the piping could be integrated and/or molded directly into the bathtub. Drain 32 can help prevent overflow when the main bathtub drain is still depressed in the sealed position. Excess water can flow through the overflow portion of the drain. When insert 30 is installed on the bathtub sidewall, drain 32 is sealed by the insert.

Figure 4A:
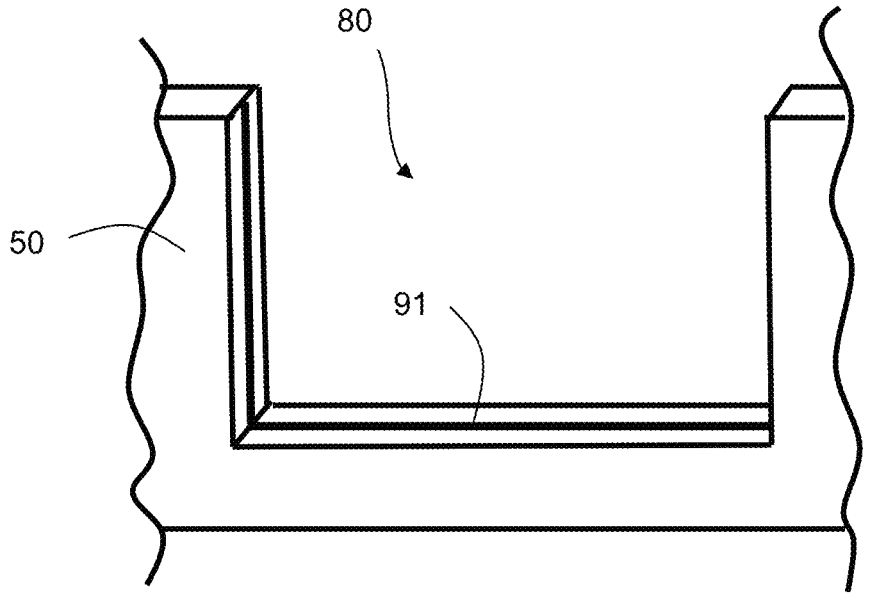
FIG. 4*a* is a fragmentary perspective view of a bathtub insert opening comprising seals in accordance with some embodiments of the presently disclosed subject matter.
Figure 4B:
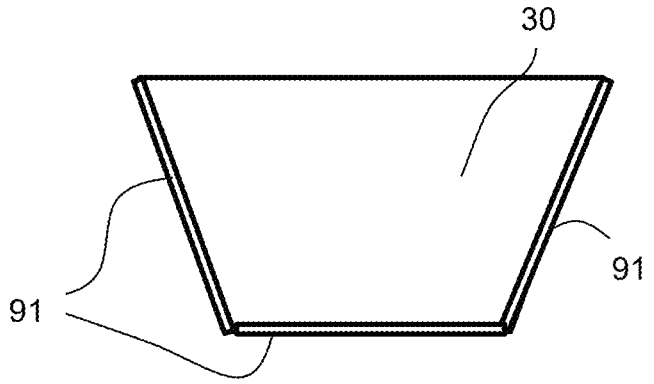
FIG. 4*b* is a front plan view of a bathtub insert comprising a plurality of seals in accordance with some embodiments of the presently disclosed subject matter.
Figure 4C:
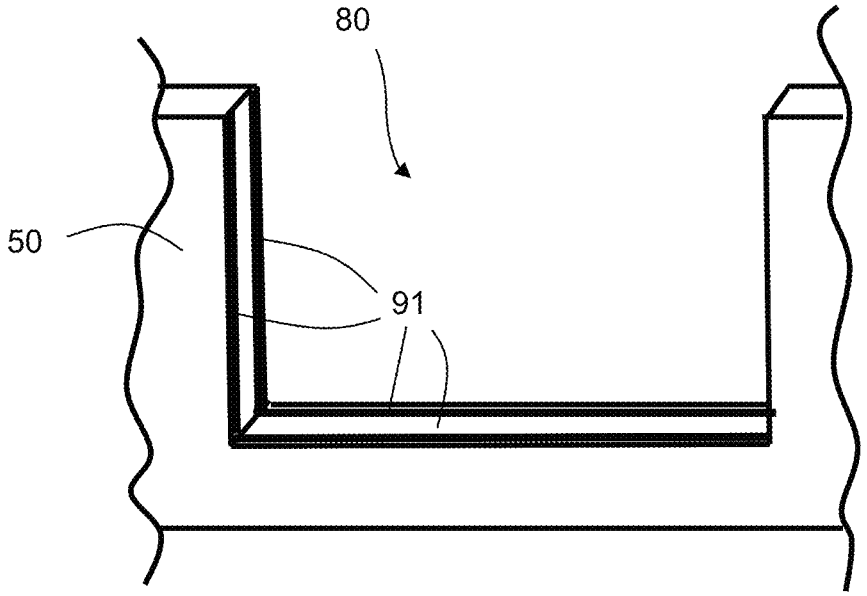
FIG. 4*c* is a perspective view of a bathtub opening comprising a pair of seals in accordance with some embodiments of the presently disclosed subject matter.

In some embodiments, opening 80 includes seal 91 to allow the insert to be watertight (e.g., not leak) when installed with sidewall 50, as shown in FIG. 4*a*. A single seal can be used, as shown. Alternatively, the seal can be configured on the bottom and side edges of the insert, as shown in FIG. 4*b*. In some embodiments, seal 91 is configured within a channel that is compressed when the insert is positioned within opening 80 to create a watertight seal. Seal 91 can be positioned on any suitable surface of insert 30 or opening 80, such as on one or more edges. Thus, the seal can be configured on the surface where the insert contacts the sidewall opening. In addition to a single seal, a pair of seals can be used, such as in a front edge and a rear edge, as shown in FIG. 4*c*.

The seal can be configured from any suitable material, as would be apparent to those of skill in the art. For example, seal 91 can be constructed from rubber, foam, polymeric material, and the like.

Figure 5:
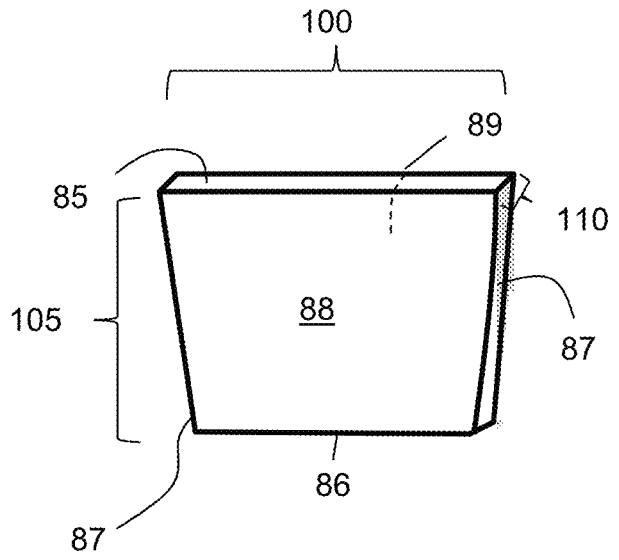
FIG. 5 is a perspective view of a bathtub insert in accordance with some embodiments of the presently disclosed subject matter.

FIG. 5 illustrates one embodiment of insert 30 comprising top edge 85, opposed bottom edge 86, side edges 87, front face 88, and rear face 89. The top edge of the insert forms a top edge of the bathtub when assembled.

The insert can be configured in any size and/or shape. For example, the insert can have length 100 of about 10-90 inches (e.g., at least/no more than about 10, 15, 20, 25, 30, 35, 40, 45, 50, 55, 60, 65, 70, 75, 80, 85, or 90 inches). The insert can also include height 105 of about 5-20 inches (e.g., at least/no more than about 5, 10, 15, or 20 inches). The section further includes thickness of about 1-10 inches (e.g., at least/no more than about 1, 2, 3, 4, 5, 6, 7, 8, 9, or 10 inches). It should be appreciated that thickness 110 of the insert is the same or about the same thickness as a sidewall of the bathtub. The insert thickness is the distance between the front and rear faces of the insert. It should be appreciated that the length, width, and thickness of insert 30 can vary and are not limited to the ranges given above.

In some embodiments, length 100 and/or height 105 of the insert can be about 40-95 percent of the total length or height of sidewall 50. Thus, if the bathtub sidewall comprising the insert has a length of about 100 inches, the sidewall can have length of about 40-95 inches. Similarly, if the sidewall has a height of about 10 inches, the insert height can be about 4-9.5 inches.

Insert 30 can have any desired shape, such as the rectangular configuration illustrated in FIG. 3*b*. However, the shape of the insert is not limited and can be configured in a square, wedged, abstract, or the like shape. Particularly, a wedged or trapezoidal shape that tapers from top edge 85 to bottom edge 86 may be advantageous in preventing leaks when installed on the tub sidewall. Specifically, as water from inside the bathtub applies pressure to the insert, the tapered shape increases the ability of the system to remain watertight.

Figure 6A:
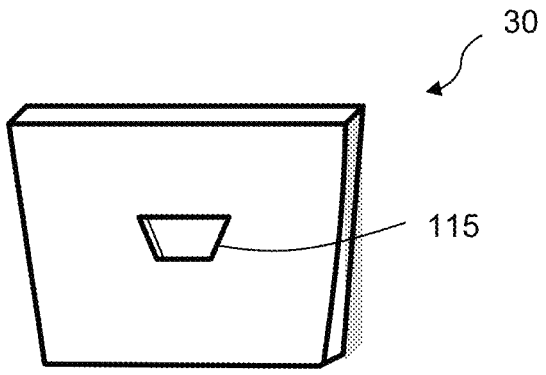
FIG. 6*a* is a perspective view of a bathtub insert comprising a mount in accordance with some embodiments of the presently disclosed subject matter.
Figure 6B:
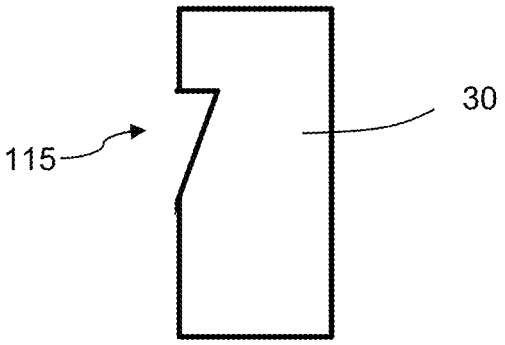
FIG. 6*b* is a side plan view of the bathtub insert of FIG. 6*a* in accordance with some embodiments of the presently disclosed subject matter.
Figure 6C:
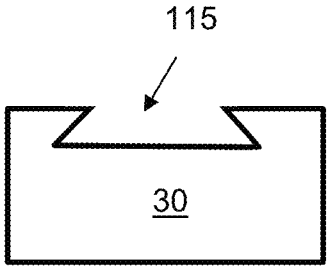
FIG. 6*c* is a top plan view of a bathtub insert in accordance with some embodiments of the presently disclosed subject matter.
Figure 6D:
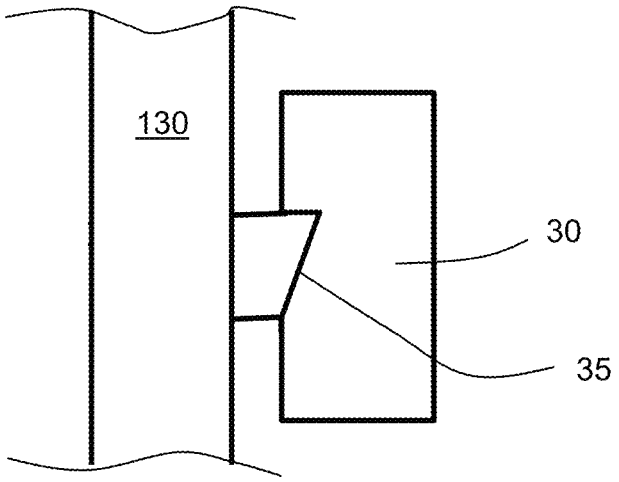
FIG. 6*d* is a side plan view of a bathtub insert configured on a hanger in accordance with some embodiments of the presently disclosed subject matter.

In some embodiments, the front or rear face of insert 30 includes mount 115 for attaching the insert to hanger 35 within the shower, as illustrated in FIGS. 6*a*-6*d*. The term "mount" broadly refers to any element that allows for removable attachment to the shower hanger, such as (but not limited to) the use of magnets, fasteners, clips, and the like. In some embodiments, the mount is recessed within the interior of the insert, also functioning as a handle when removing the insert from the bathtub sidewall. The size and shape of the mount are not limited and can be configured in any desired size or shape so long as the mount can cooperate with hanger 35. In use, the mount is configured on a corresponding hanger 35, as shown in FIG. 6*d*. Specifically, at least a portion of the hanger is sized and shaped to fit into mount 115. It should be appreciated that mount 115 is optional and the insert can be configured without the mount. Further, it is not mandatory that the insert cooperate with the hanger. Rather, after the insert has been removed, it can be stored in a secondary location (e.g., closet, under the bed) where it is out of the way until needed.

Figure 7A:
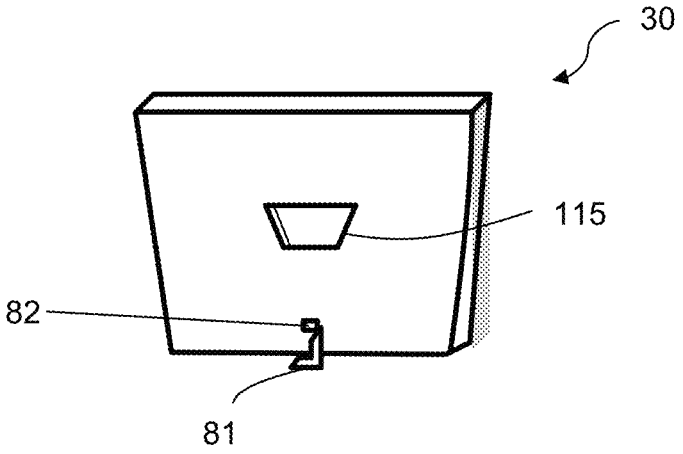
FIG. 7*a* is a perspective view of an insert comprising a cam latch in accordance with some embodiments of the presently disclosed subject matter.

In some embodiments, the insert can include latch 81 to engage and draw down the insert to compress seals 91 when in the bathtub configuration, as shown in FIG. 7*a*. The term "latch" can include any element that can secure, lock, and/or press down the insert relative to the bathtub sidewall. In some embodiments, the latch can be a cam latch. The term "cam latch" refers to a device that locks, comprising a base and a cam lever. The cam can be positioned on the insert, above overflow drain 32 such that the drain functions as the receiving latch portion of the cam. When in the place, the cam latch will seal the drain. The insert can optionally include lock 82 that allows a user to secure the insert into position in the bathtub sidewall opening. A key or other element can be used to unlock the lock, allowing the insert to be removed. For example, an allen wrench can be used as a key, inserted into lock 82 to lock the insert into place and remove the insert when desired by the user, although any conventional key/lock arrangement can be used.

Figure 7B:
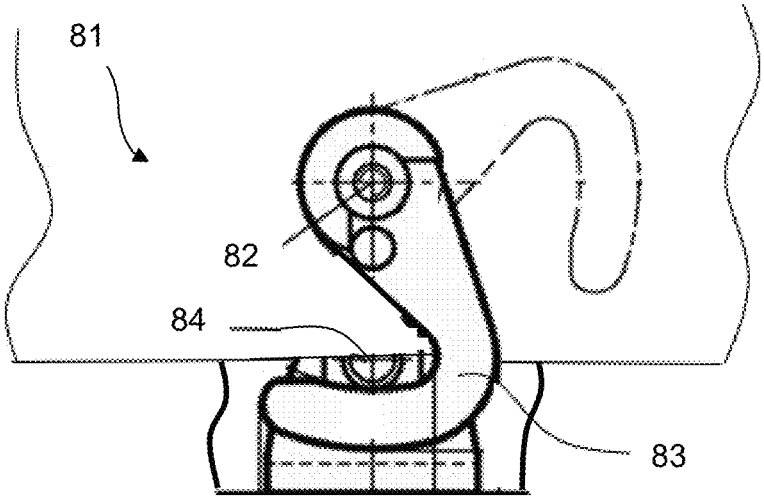
FIG. 7*b* is a front plan view of an insert comprising a latch cooperating with a bathtub sidewall in accordance with some embodiments of the presently disclosed subject matter.

FIG. 7*b* illustrates one embodiment of latch 81 configured with movable element 83 that can releasably interact with catch 84 on a bathtub sidewall to secure the insert into the bathtub sidewall. As shown in phantom, the hook can be rotated away from catch 84 to release the insert, allowing a user to remove it from the bathtub as desired. It should be appreciated that the movable element can be positioned on any surface of the insert, adjacent to the bathtub sidewall.

Figure 7C:
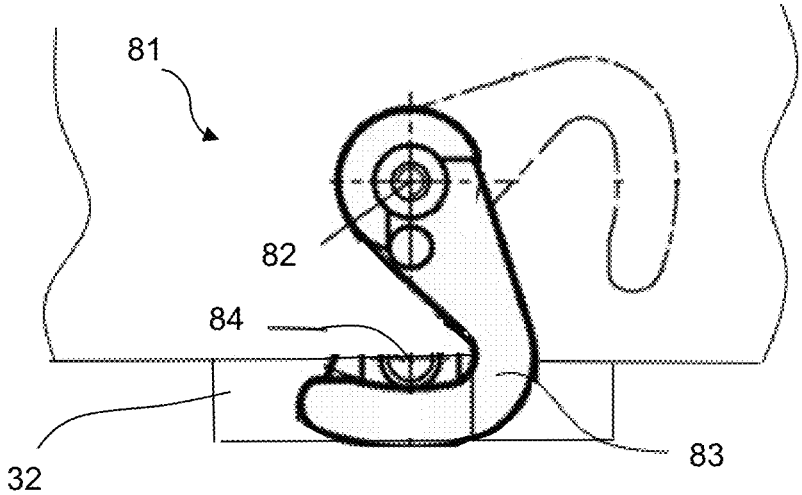
FIG. 7*c* is a front plan view of an insert comprising a latch cooperating with a bathtub sidewall drain in accordance with some embodiments of the presently disclosed subject matter.
Figure 7D:
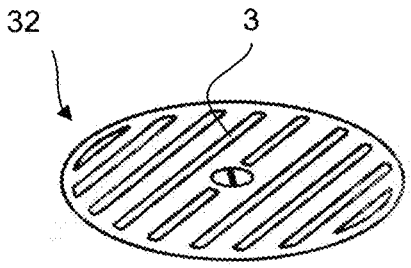
FIGS. 7*d* and 7*e* are perspective views of overflow drains in accordance with some embodiments of the presently disclosed subject matter.
Figure 7E:
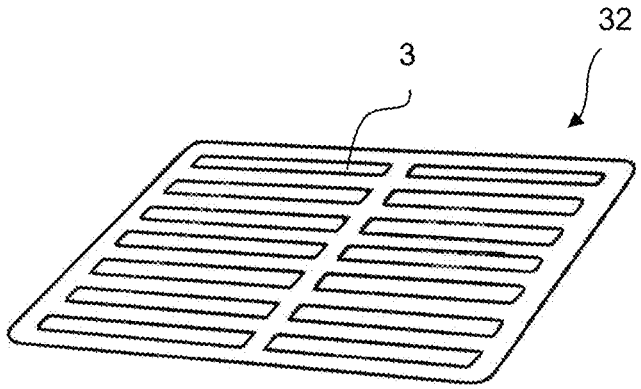
Figure 7F:
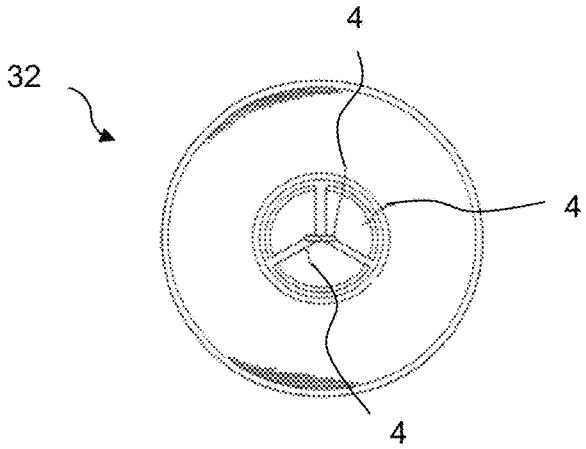
FIG. 7*f* is a top plan view of an overflow drain in accordance with some embodiments of the presently disclosed subject matter.
Figure 7G:
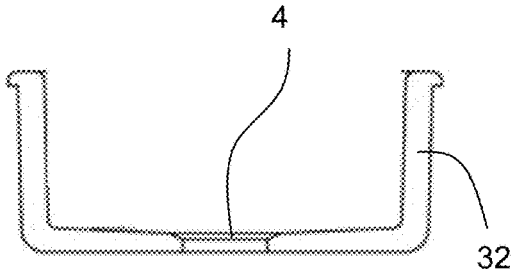
FIG. 7*g* is a side cutaway view of an overflow drain in accordance with some embodiments of the presently disclosed subject matter.

Alternatively, the latch can be at least partially recessed within the interior of the insert, configured to rotate in the closed position to communicate with overflow drain 32. As shown in FIG. 7*c*, when in the closed or locked position (retaining the insert within the bathtub sidewall), movable element 83 cooperates with the overflow drain to lock the insert into position (e.g., exerting pressure on seals 91). The overflow drain can include grid pattern 3 or any support element 4 that acts as a catch, allowing the movable to releasably connect with, as shown in FIGS. 7*d*-7*g*. The overflow drain can be recessed within the bathtub sidewall or flush within opening 80.

However, it should be appreciated that any type of latch can be used, such as (but not limited to) compression latches, slam latches, draw latches, sliding latches, and the like. In use, a key, hand, or tool can be used to rotate the cam which latches the insert into opening 80. Still further, the insert is not limited to the use of latches and can be releasably retained within a bathtub sidewall using any element, such as (but not limited to) the use of magnets, clips, fasteners, snap-fit arrangement, pressure-fit arrangement, and the like.

Bathtub 10 and insert 30 can be constructed from any desired material, such as (but not limited to) fiberglass, molded fiberglass sheets, composite material, glass, polymer, porcelain-enameled metal (e.g., steel, cast iron), acrylic, metal (e.g., copper), stone, or combinations thereof. It should be appreciated that bathtub 10 and insert 30 are not limited to the materials set forth above.

Figure 8:
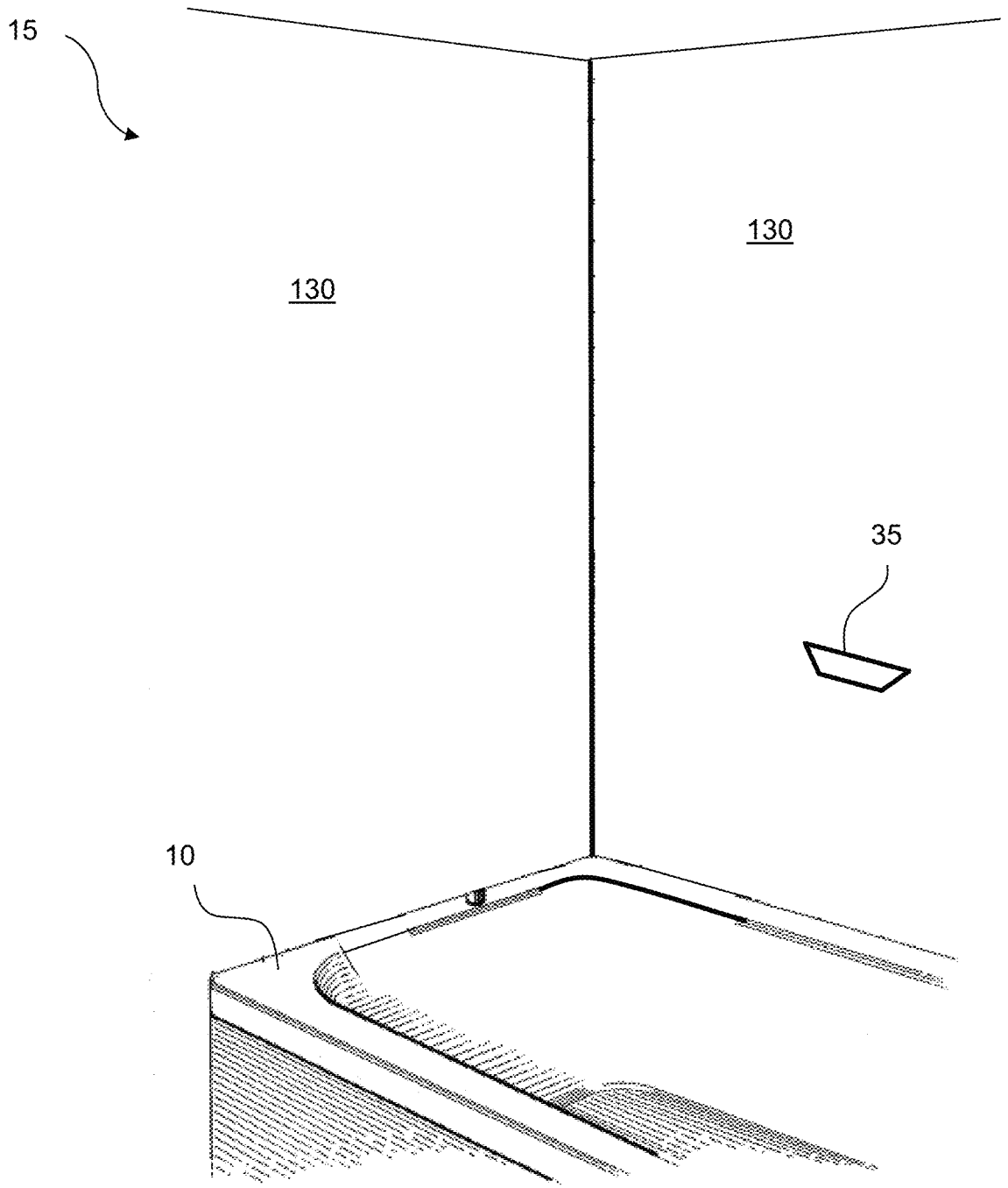
FIG. 8 is a perspective view of an assembly shower comprising an adjacent bathtub in accordance with some embodiments of the presently disclosed subject matter.

Shower 15 can be any suitable shower, such as those including tile or fiberglass, and the like. Typically, the shower will include vertically extending walls 130 to create an enclosed space for bathing, as shown in FIG. 8. The shower can be constructed above and adjacent to bathtub 10 to prevent water leaks. In some embodiments, the shower and bathtub can be configured as a single unit. In other embodiments, the shower is constructed around the bathtub.

Figure 9A:
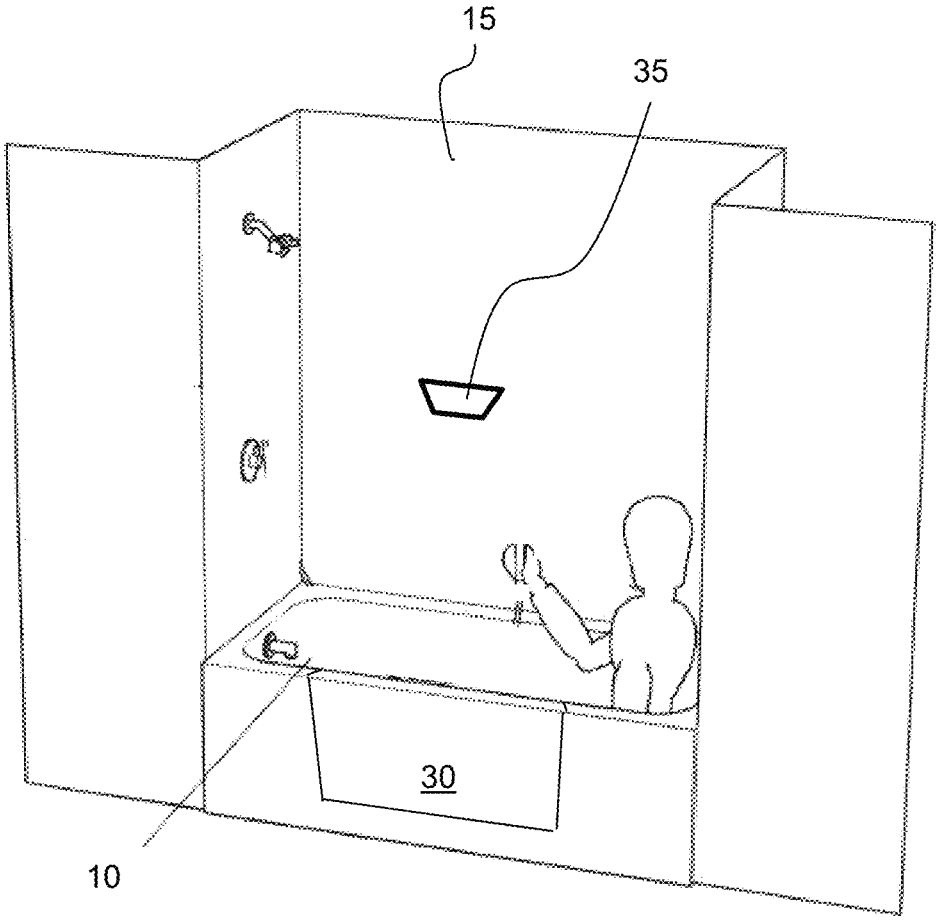
FIG. 9*a* is a perspective view of a bathing assembly in accordance with some embodiments of the presently disclosed subject matter.
Figure 9B:
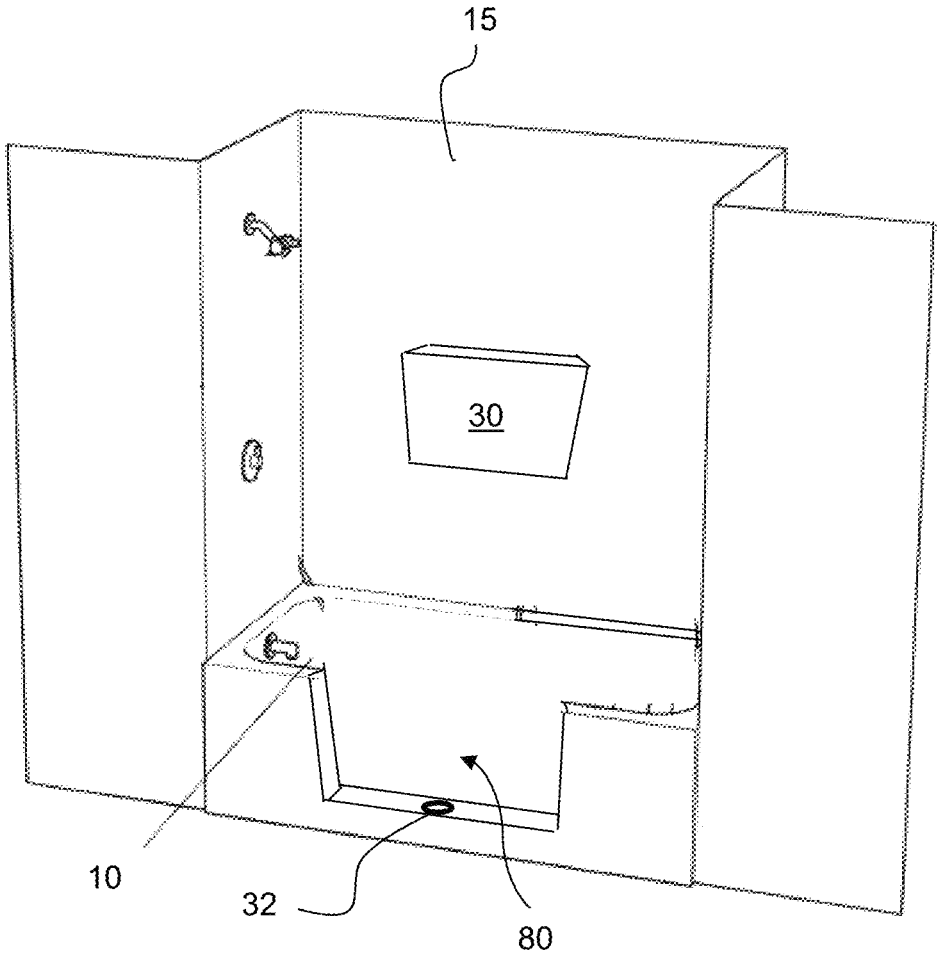
FIG. 9*b* is a perspective view of a bathing assembly with the insert removed in accordance with some embodiments of the presently disclosed subject matter.

In use, insert 30 can be installed on an entry sidewall of a bathtub, as shown in FIG. 9*a*. In this configuration, a user is free to take a bath within the interior of the bathtub. When the user desires to take a shower, insert 30 can be quickly and easily removed from bathtub sidewall 50 and positioned outside the bathing assembly or can be positioned on hanger 35 within the interior of the shower, as shown in FIG. 9*b*. In these embodiments, the insert can function as a shelf, allowing the user to store items on the top surface. Opening 80 is left in the sidewall where the insert has been removed. The opening functions as an entry to the shower, such that the user does not have to step over a large lip or bathtub sidewall. In addition, overflow drain 32 is exposed within the lower surface of the opening as an overflow safety feature.

When the user desires to replace the insert into opening 80, it can be easily removed from hanger 35 and aligned and repositioned using cam latch 81, as described above. The insert is then secured into place against sidewall 50 to create a watertight seal. The user can then use the bathtub to take a bath as desired.

Bathing assembly 5 offers many advantages over prior art bathtub and shower assemblies. Specifically, assembly 5 is convertible allowing the user versatility to either take a shower or bath easily.

Assembly 5 is easy to use, enabling children, adults, the elderly, and disabled persons to easily use and convert the assembly as desired.

Overflow drain provides an added safety feature, preventing or reducing the incidence of escape of water from the assembly when the shower is being used.

Assembly can be easily retrofitted on an existing bathtub, providing a cost savings to the user. Alternatively, the bathtub can be removed and replaced with the assembly disclosed herein.

Advantageously, the bathtub can be used for bathing with normal water levels and converted to a shower with no step over barrier like a shower.

When installed on the hanger in the shower, insert 30 can function as a shelf, saving space within the interior of the shower.

The foregoing descriptions have been presented for purposes of illustration and description and are not intended to be exhaustive or to limit the presently disclosed subject matter. Many modifications and variations are possible in light of the present disclosure.

What is claimed is:

1. A bathing assembly comprising:

a shower base defined by one or more walls;

a bathtub unit defined by interconnected sidewalls and a base that create an upper bathtub edge and an interior with a central opening;

a removable sidewall insert that includes a portion of the top edge of one of the bathtub sidewalls, wherein the insert is removable from one of the bathtub sidewalls to create a sidewall opening defined by two sides and a bottom edge;

wherein the bottom edge of the sidewall opening comprises a drain;

wherein the removable insert comprises a cam latch positioned on a front face and proximate to the bottom edge of the removable insert, the cam latch defined by a base and a lever pivotable between a first position and a second position; and a catch positioned on a bathtub sidewall, configured below the cam latch when the removable insert is installed on the bathtub sidewall;

wherein the cam latch lever is configured to interact with the catch in the first position and to rotate away from the catch in the second position;

wherein the cam latch is configured to actuate to release the insert from the bathtub opening upon demand.

2. The bathing assembly of claim 1, wherein the bathtub unit and the shower base are molded together as one unitary piece.

3. The bathing assembly of claim 1, wherein the insert includes a mount that cooperates with a hanger positioned on one wall of the shower.

4. The bathing assembly of claim 3, wherein the mount is configured as a recess.

5. The bathing assembly of claim 1, wherein the sidewall opening is configured on an entry side of the bathtub.

6. The bathing assembly of claim 1, further comprising a seal positioned around the edges of the bathtub opening, around the edges of the removable insert, or both.

7. The bathing assembly of claim 1, wherein the removable insert is configured in a wedge shape with tapered ends.

8. The bathing assembly of claim 1, wherein the removable insert has a length of about 10-90 inches and a width of about 5-20 inches.

9. The bathing assembly of claim 1, wherein the thickness of the removable insert is equal to the thickness of the corresponding bathtub sidewall.

10. A method of converting a bathtub to a shower, the method comprising:

removing a bathtub insert from a sidewall of a bathing assembly, the bathing assembly defined by:

a shower base defined by one or more walls;

a bathtub unit defined by interconnected sidewalls and a base that create an upper bathtub edge and an interior with a central opening;

a removable sidewall insert that includes a portion of the top edge of one of the bathtub sidewalls, wherein the insert is removable from the sidewall to create a sidewall opening defined by two sides and a bottom edge;

wherein the bottom edge of the sidewall opening comprises a drain;

wherein the removable insert comprises a cam latch positioned on a front face and proximate to the bottom edge of the insert, the cam latch defined by a base and a lever pivotable between a first position and a second position; and a catch positioned on a bathtub sidewall, configured below the cam latch when the removable insert is installed on the bathtub sidewall;

wherein the cam latch lever is configured to interact with the catch in the first position and to rotate away from the catch in the second position;

wherein the cam latch is configured to actuate to release the insert from the bathtub opening upon demand;

wherein removing the insert exposes the sidewall opening to allow for entry into the shower, thereby converting the bathtub into a shower.

11. The method of claim 10, wherein the shower is returned to a bathtub by repositioning the insert within the sidewall opening and actuating the retention element to lock the insert into position.

12. The method of claim 10, wherein the insert includes a mount and the insert cooperates with a hanger positioned on one wall of the shower.

13. The method of claim 12, wherein the mount is configured as a recess.

14. The method of claim 10, wherein the sidewall opening is configured on an entry side of the bathtub.

15. The method of claim 10, wherein the edges of the bathtub opening comprise a seal, the edges of the removable insert comprise a seal, or both.

16. The method of claim 10, wherein the removable insert is configured in a wedge shape that tapers from a top edge to a bottom edge.

17. The method of claim 10, wherein the removable insert has a length of about 10-90 inches and a width of about 5-20 inches.

18. The method of claim 10, wherein the thickness of the removable insert is equal to the thickness of the corresponding bathtub sidewall.

19. A bathing assembly comprising:

a shower base defined by one or more walls;

a bathtub unit defined by interconnected sidewalls and a base that create an upper bathtub edge and an interior with a central opening;

a removable sidewall insert that includes a portion of the top edge of one of the bathtub sidewalls, wherein the insert is removable from one of the bathtub sidewalls to create a sidewall opening defined by two sides and a bottom edge;

wherein the bottom edge of the sidewall opening comprises a drain;

wherein the removable insert comprises a cam latch at least partially recessed within an interior of the insert, the cam latch defined by a base and a lever pivotable between a first position and a second position; and a catch positioned within the drain;

wherein the cam latch lever interacts with the catch in the first position and rotates away from the catch in the second position;

wherein the cam latch is configured to actuate to release the insert from the bathtub opening upon demand.

20. The method of claim 19, wherein the catch is configured as a grid pattern.

* * * * *